United States Patent [19]

Staggs et al.

[11] Patent Number: 4,907,660

[45] Date of Patent: Mar. 13, 1990

[54] INTERCHANGEABLE SECTIONAL MINING DRILL AND BOLT DRIVER SYSTEM

[76] Inventors: Arnol Staggs; Margarita Flores, both of 1155 Lincoln, Wyandotte, Mich. 48192

[21] Appl. No.: 170,993

[22] Filed: Mar. 21, 1988

[51] Int. Cl.[4] ..... E21B 17/00

[52] U.S. Cl. ..... 175/320; 175/318; 81/177.85; 279/103; 285/403

[58] Field of Search ..... 175/320, 318; 299/81, 299/91; 285/12, 305, 403, 404; 279/79, 102, 103, 20; 408/239 R, 239 A, 59–61; 81/177.85, 177.1, 177.2; 137/515, 515.3, 515.5, 515.7; 29/453, 465, 469, 526 R

[56] References Cited

U.S. PATENT DOCUMENTS

| | | | |
|---|---|---|---|
| 1,785,271 | 12/1930 | Lemex | 137/515.5 |
| 1,890,223 | 12/1932 | Kilzer | 137/515.3 |
| 3,752,514 | 8/1973 | Shoeps | 403/377 |
| 4,099,585 | 7/1978 | Emmerich | 175/410 X |
| 4,127,279 | 11/1978 | Wright | 279/20 X |
| 4,165,790 | 8/1979 | Emmerich | 175/410 |
| 4,190,128 | 2/1980 | Emmerich | 175/320 X |
| 4,206,821 | 6/1980 | Emmerich | 279/103 X |
| 4,226,290 | 10/1980 | McSweeney | 175/320 |
| 4,299,295 | 11/1981 | Gossard | 175/45 |
| 4,615,402 | 10/1986 | Eisenloeffel | 175/320 |
| 4,632,195 | 12/1986 | Emmerich | 279/103 X |

*Primary Examiner*—Bruce M. Kisliuk
*Attorney, Agent, or Firm*—Arnold S. Weintraub; William D. Blackman

[57] ABSTRACT

An interchangeable, sectional mining drill and bolt driver system for use with a drilling machine, includes a chuck, a driver, a bolt wrench-drill steel driver, a combination driver, a male hex coupler, a female hex coupler, a universal bar, a flat spring-double dimple clip, and a drill bit. The system can be converted from a vacuum debris removal system to a water debris flushing system by connecting a main water valve to a water system base and inserting a first water valve, a second water valve, and a finishing water insert into respective sections of the mining drill system.

18 Claims, 5 Drawing Sheets

INTERCHANGEABLE SECTIONAL MINING DRILL AND BOLT DRIVER SYSTEM

BACKGROUND OF THE INVENTION

1. Field of the Invention:

The invention relates, in general, to mining tools and, more specifically, to an apparatus for use in a mining drill and bolt driver system mountable on a chuck of a drilling machine.

2. Description of the Prior Art:

In the mining industry, federal and state safety laws require that roof bolts be installed on the roof of each mine to provide support for the roof to prevent collapse or cave-in. The roof bolts generally comprise an elongated bolt having an expandible nut mounted at one end and a square plate mounted at the other end. The bolt is inserted into a hole in the roof of the mine and the bolt is torqued to cause the nut to expand and anchor itself in the rock. The plate on the bottom of the bolt provides support for the roof of the mine to prevent collapse.

A variety of drills are commonly employed to form the holes in the roof of mines. A typical drill has a cone-shaped head which removably receives a carbide insert or cutting bit and is formed to allow the removal of dirt and debris from the cutting area. The opposite end of the drill is inserted into a hollow bar, commonly referred to as drill steel or a drill driver, which provides a means for rotating the bit. The bar, in turn, fits into a conventional drilling machine.

The holes used in mining applications are sometimes quite deep and a drill driver may have several sections of shafts linked together before the hole is complete. It has been customary in the rotation of the cutting bits to utilize a starter element, a driver, a middle extension, and a finish extension. The term "drilling steel" is sometimes used to describe the elements which are driving a cutting bit in rock drilling.

Such drills, while generally effective in forming holes in mine roofs which meet federal and state regulations for size, tolerance, and concentricity, are not without drawbacks. For example, it is not uncommon for an entire unitary starter element, or driver, or middle extension, or finish extension to be discarded merely because one end of the member has become worn or damaged. Replacement of these discarded elements greatly increases the cost of operating and maintaining the drilling system in satisfactory condition.

With the present invention of a mining drill and bolt driver system, the individual elements are separable into interchangeable sections so that only the worn or damaged section need be discarded and replaced, thereby greatly reducing the cost of maintaining the equipment. The present invention is also adapted for use in systems utilizing either a vacuum suction debris collection system or a pressure water debris flushing system. In addition, the present system is simple and the individual elements are easily transportable, thereby making the replacement of individual sections more efficient saving time for the operator in the mine.

The present mining drill and bolt driving system is adapted to use the mining drill disclosed and claimed in my previous U.S. Pat. No. 4,461,362 which is incorporated herein by reference.

SUMMARY OF THE INVENTION

There is disclosed herein a unique mining drill and bolt driver system which is suitable for use in mine roof drilling operations. The mining drill and bolt driver system includes a chuck, a square driver, a bolt wrench-drill steel driver, a combination driver, a male hex coupler, a female hex coupler, a universal bar, a drill bit, and a flat spring clip. A pressurized water deris flushing system can be releasably secured within the various elements of the mining drill and bolt driver system and supported by a water system base. The flushing system includes a water system base, a first normally closed water valve, a second normally closed water valve, and a finishing extension water insert.

The chuck attaches to a conventional drilling machine for rotationally driving the drill steel. The chuck has a generally cylindrical exterior surface with a plurality of longitudinally extending gears or splines. Each end of the chuck has a square recess defining a female square fitting. The female square fitting at the first end is rotationally offset about the longitudinal axis of the chuck from the square fitting of a second end by 45 degrees. A longitudinal through bore connects the female square fitting of the first end to the female square fitting of the second end.

The square driver attaches the drill steel to the chuck, which is driven by a conventional drilling machine. The square driver has an external square cross-section throughout its entire length, defining male square fittings at both ends. The square driver has a longitudinal through bore and retaining apertures spaced from one end.

The bolt wrench-drill steel driver attaches the drill steel to the square driver or, can be used as a bolt wrench to engage the bolt to be driven into the roof of the mine. The bolt wrench-drill steel driver has a cylindrical exterior surface with first and second ends, each end having a square recess defining a female square fitting. The female square fitting at the first end is rotationally offset about the longitudinal axis of the bolt wrench-drill steel driver from the square fitting of the second end by 45°. Each female square fitting has retaining apertures alignable with the square driver, enabling the bolt wrench-drill steel driver to be reversible.

A first combination driver attaches the drill steel to the drill steel driver or, in the alternative, attaches the bolt wrench to the drill steel. A second combination which is substantially identical to the first combination driver can attach the main water line valve to the chuck of the drilling machine, when using a water flushing system, and a third combination driver can be used to attach the first normally closed water valve, in a water flush system, between the chuck of the drilling machine and the drill steel. The first combination driver has a first end with a square external cross-section defining a male square fitting having retaining apertures alignable with the retaining apertures of the drill steel driver, and a second end having a hexagonal shaped recess defining a female hex fitting with clip-engaging apertures spaced from the second end and a longitudinal bore communicating with the female hex fitting through the first end.

The male hex coupler connects two female hex fittings together. The male hex coupler has a hexagonal shaped exterior surface, defining male hex fittings at each end, and has a longitudinal bore throughout its entire length. A first end of the male hex coupler has a longitudinal recess with a clip-engaging aperture spaced from the first end, and a second end of the male hex coupler has two longitudinal slots in opposing sidewalls with a longitudinal recess extending from one of the slots with a clip-engaging aperture spaced from the second end.

The female hex coupler connects two male hex fittings together, and has a cylindrical exterior surface with a hexagonal shaped interior bore defining first and second female hex fittings at a first end and a second end respectfully. Each female hex fitting has a clip-engaging aperture spaced from the end of the female hex coupler.

The universal bar has an elongated cylindrical shape with a longitudinal bore through its entire length and identical first and second ends. The first and second ends of the universal bar have hexagonal shaped exterior surfaces defining male hex fittings with a longitudinal recess extending from each end and having a clip-engaging aperture spaced from each end of the universal bar.

The flat spring clip releasably locks the female hex fittings and male hex fittings together. The flat spring clip has a first dimple at one end extending outwardly from a first surface and a second dimple at another end extending outwardly from a second surface.

The bit is mountable on the drill steel at an end opposite from the chuck. The bit has a substantially cylindrical form with an annular portion and a tapered conical end portion. The annular portion includes a hexagonal shaped recess defining the female hex fitting for engagement with a male hex fitting of the drill steel. An internal bore extends partially through the bit from the female hex fitting and communicates with at least one and preferably a pair of apertures formed in the annular portion and the tapered conical end portion to direct dirt and debris generated during the cutting or drilling operation into the bore for removal from the cutting area in a vacuum debris removal system, or to direct water through the bit during the cutting or drilling operation for removal from the cutting area in a water flush debris removal system. The bit includes a clip-engaging aperture spaced from the annular portion end of the bit.

The water system base releasable anchors a main water valve in a fluid flow debris flushing system. The water system base includes a support member attached to a nonrotatable collection pan and adjustable anchoring means extending through the support member contacting the main water valve. The adjustable anchor means can include spring means for dampening the vibration from the drill steel.

The first normally closed water valve can be threadingly engaged within the first end of the combination driver. The first normally closed water valve includes a first nozzle at a first end, an externally threaded cylindrical body threadingly engagable within the combination driver, a second end including a valve housing enclosing a integral valve seat wall, a valve seal engagable with the valve seal wall, a reciprocal valve member engagable with the valve seal, and means for biasing the reciprocal valve member in a normally closed direction.

The second normally closed water valve is insertable in a simulated extension bar, including a universal bar connected to a female hex coupler with a flat spring clip. The second valve includes an elongated hollow tubular section having first and second ends. The first end has an external hexagonal shaped cross section defining a male hex fitting having a longitudinal recess with a clip-engaging aperture disposed spaced from the second end, and a nozzle with an opening in communication with the hollow longitudinal bore of the elongated tubular section. The second end includes a valve housing enclosing an integral valve seat wall, a valve seal engagable with the valve seat wall, a reciprocal valve member engaging the valve seal, and means for biasing the reciprocal valve member in a normally closed direction.

The finishing extension water insert is insertable in a universal bar immediately adjacent a drill bit. The insert includes an elongated hollow tubular section having first and second ends. The first end has a nozzle with an opening in communication with the longitudinal bore of the elongated tubular section, and the second end has an enlarged portion engagable within the drill bit having a pair of elongated longitudinal recesses spaced from the second end.

BRIEF DESCRIPTION OF THE DRAWINGS

The various features, advantages and other uses of the present invention will become more apparent by referring to the following detailed description and drawings in which:

FIG. 12 is a side view of a female hex coupler;

DESCRIPTION OF THE PREFERRED EMBODIMENTS

Figure 1:
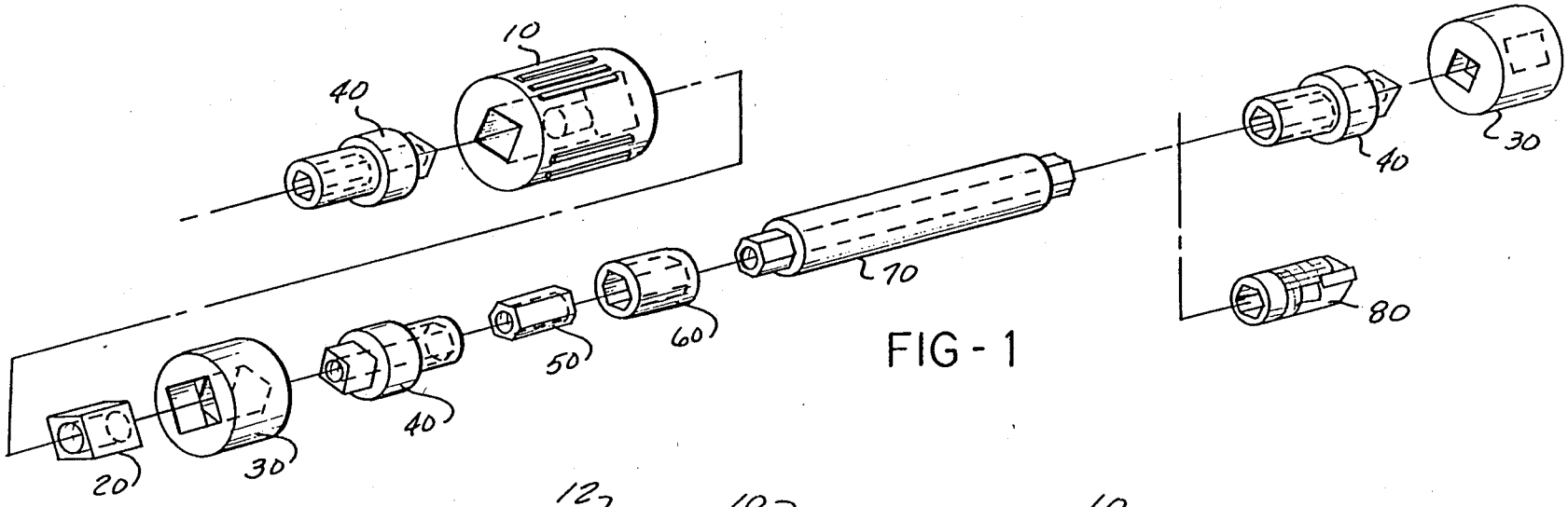
FIG. 1 is an exploded perspective view of an interchangeable sectional mining drill and bolt driver system.
Figure 30:
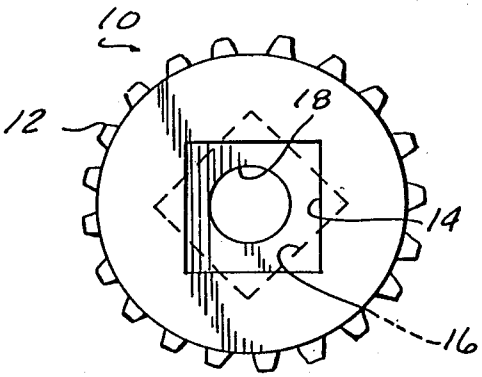
FIG. 30 is an end view of the chuck shown in FIG. 29.
Figure 29:
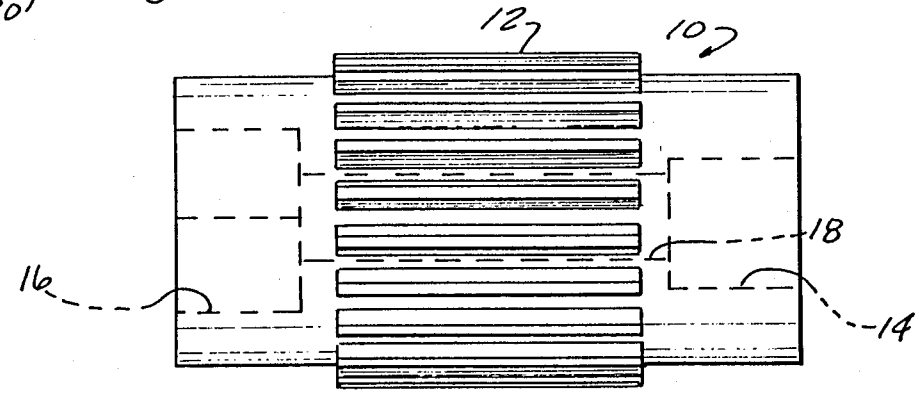
FIG. 29 is a side view of a chuck.

The basic concept of the interchangeable sectional mining drill and bolt driver system is shown in the exploded perspective view of FIG. 1. A chuck 10 driven by a conventional drilling machine is used as the means for driving the mining drill and bolt driver system in a rotational direction. The chuck 10 shown in FIGS. 29 and 30 has a generally cylindrical exterior surface with a plurality of longitudinally extending teeth or splines 12. The chuck 10 also has a longitudinal passage 18 through the center of the chuck 10 with square recesses, 14 and 16 respectively, at both ends defining female square fittings. The square recesses, 14 and 16, are offset angularly about the longitudinal axis by 45° with respect to one another. The present invention also includes a square driver 20, a bolt wrench-drill steel driver 30, a combination driver 40, a male hex coupler 50, a female hex coupler 60, a universal bar 70, and a drill bit 80. Each of these elements of the system will be described in further detail separately in conjunction with the figures illustrating the preferred configuration of each element and multiple uses of any of the elements may be made in setting up any given drilling hardware arrangement according to the need of a particular situation, such as, e.g., the three instances of the combination driver 40 shown in FIG. 1.

Figures 2, 3, 4, 5, 18, 21, 22, 23:
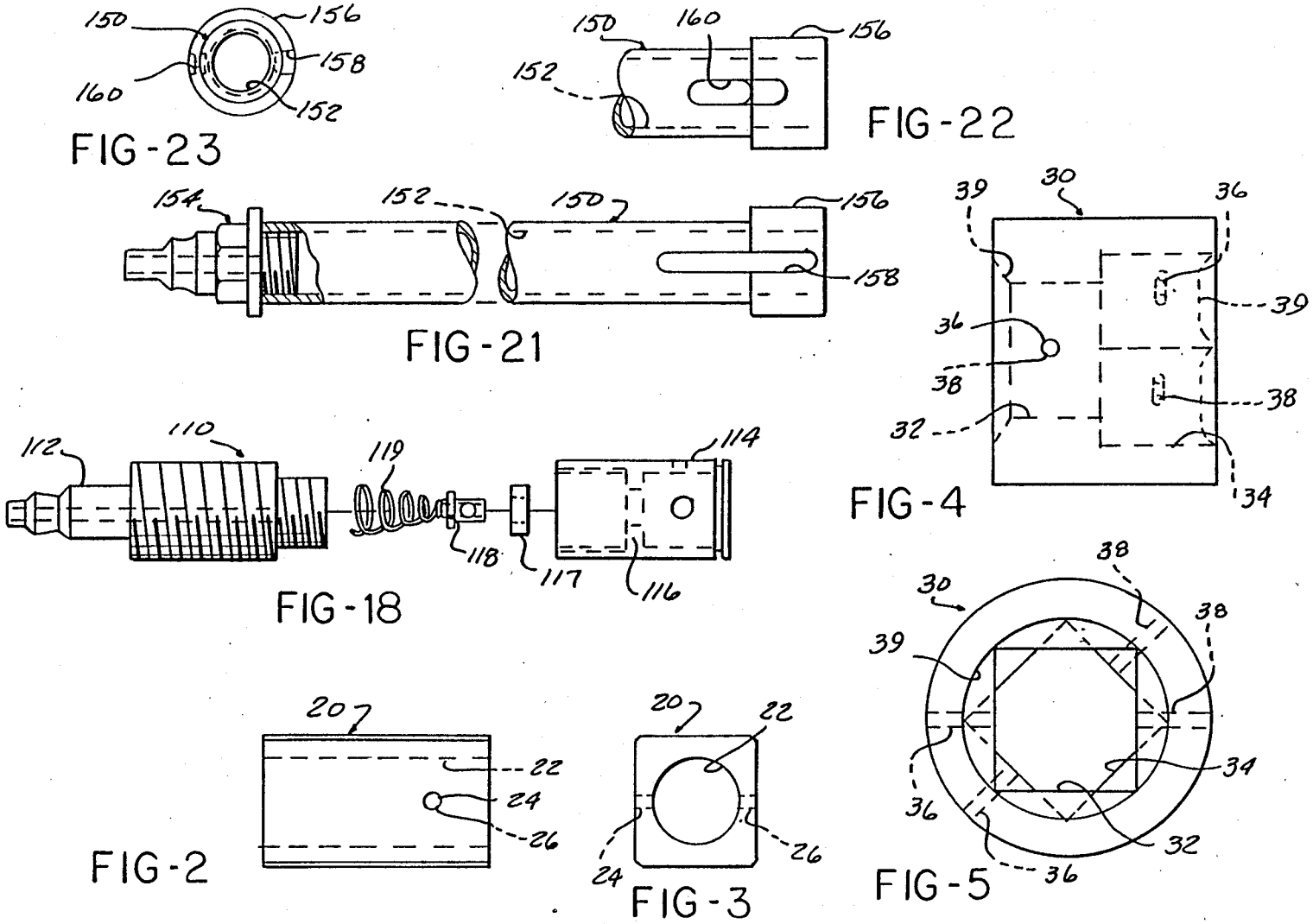
FIG. 2 is a side view of a square driver.
FIG. 3 is an end view of a square driver.
FIG. 4 is a side view of a bolt wrench-drill steel driver.
FIG. 5 is an end view of the bolt wrench-drill steel driver.
FIG. 18 is an exploded side view of a first normally closed water valve.
FIG. 21 is side view of a finishing extension water insert.
FIG. 22 is a partial side view of a second end of the finishing extension water insert rotated about a longitudinal axis 180° from the view shown in FIG. 21.
FIG. 23 is an end view of the finishing extension water insert.

Referring now to FIG. 2 and 3, the square driver 20 is shown in a side view and end view respectively. The square driver 20 has an exterior square cross section throughout an entire length of the square driver 20. Preferably, the longitudinal edges of the square driver 20 are beveled slightly to provide easier engagement within the chuck 10. A longitudinal bore 22 passes through the entire length of the square driver 20 providing passage means for either debris, in a vacuum debris removal system, or for water, in a water debris flushing system. At least one end of the square driver 20 includes retaining apertures 24 and 26 for releasably securing the square driver 20 to the bolt wrench-drill steel driver 30 with set screws, roll pins, dowels, or the like. The square external surface of the square driver 20 defines male square fittings at each end of the square driver 20.

The bolt wrench-drill steel driver 30 is shown in side view in FIG. 4 and in end view in FIG. 5. The bolt wrench-drill steel driver 30 has a cylindrical exterior surface with first and second ends. The first and second ends have square recesses defining first and second female square fittings, 32 and 34 respectively. The first and second female square fittings, 32 and 34 respectively, are in communication with one another forming longitudinal passage means through the bolt wrench-drill steel driver 30. The first female square fitting 32 is rotationally offset about the longitudinal axis from the second female square fitting 34 by 45° . Each female square fitting, 32 and 34 respectively, include retaining apertures, 36 and 38 respectively alignable with the retaining apertures, 24 and 26 respectively of the square driver 20. Preferably, the bolt wrench-drill steel driver 30 has a counter sunk portion 39 at each end having a diameter approximately the same as the diagonal of the female square fittings, 32 and 34 respectively. The identical ends of the bolt wrench-drill steel driver 30 permit the element to be reversible. The bolt wrench-drill steel driver 30 also has multiple uses as shown in FIG. 1, when mounted adjacent the chuck 10 it acts as a drill steel driver, and when mounted at the end of the drill steel it can engage the head of a bolt, thereby acting as a bolt wrench.

It has been found that pressure points normally occur at the corners of the male and female square fittings which exist on the square driver 20, the bolt wrench-drill steel driver 30, and the combination driver 40. These pressure points generally result in excessive wear and deformation of the metal in the corners of these fittings. In an effort to alleviate or reduce this excessive wear it has been found that it is preferable to accurately machine the length and depth of the male and female square fittings respectively to a uniform dimension such as $\frac{7}{8}$ of an inch. This assists in equalizing the pressure between the opposing surfaces of the male and female square fittings. In addition, in the case of the bolt wrench-steel driver 30 and the combination driver 40, the accurate longitudinal dimension provides for distribution of the longitudinal pressure between the male and female square fittings as well as on the longitudinally perpendicular surfaces forming shoulders of the cylindrical portions of the bolt wrench-drill steel driver 30 and the combination driver 40. Ceramic or carbide coatings on the bottom surfaces of the male and female square fittings have been found to greatly increase the life of these fittings. The side surfaces of the male and female square fittings also have a ceramic carbide coating to further extend the life of the fittings.

Figure 8:
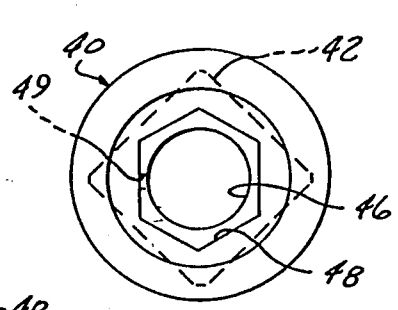
FIG. 8 is an end view of a second end of the combination driver.
Figure 6:
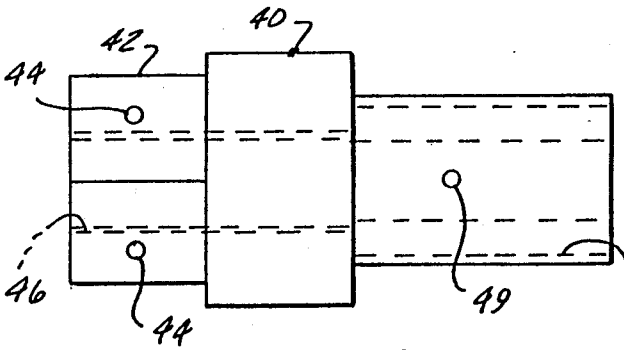
FIG. 6 is a side view of a combination driver.
Figure 7:
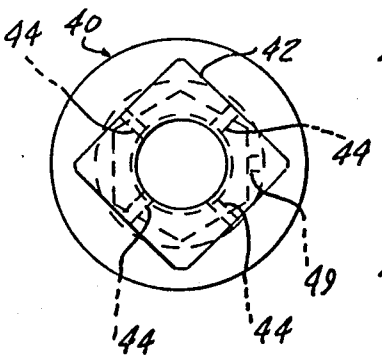
FIG. 7 is an end view of a first end of the combination driver shown in FIG. 6.

The combination driver 40 is shown in FIGS. 6 through 8. The combination driver 40 has a first end with an external square cross section defining a male square fitting 42 with retaining apertures 44 alignable with the retaining apertures 36 and 38 of the bolt wrench-drill steel driver 30 to secure the bolt wrench-drill steel driver 30 to the combination driver 40 with set screws, roll pins, dowels, or the like. A longitudinal bore 46 passes through the combination driver 40 and is in communication with a hexagonal shape recess in a second end of the combination driver 40 defining a female hex fitting 48. The longitudinal bore 46 can be threaded for threadingly receiving a first normally closed water valve 110 for use in a water debris flushing system, which will be described in further detail below. The retaining apertures 44 can also be used to secure the first normally closed water valve 110 in a selected position within the combination driver 40 by use of a set screw. The female hex fitting 48 includes a clip-engaging aperture 49 spaced from the second end.

Figure 11:
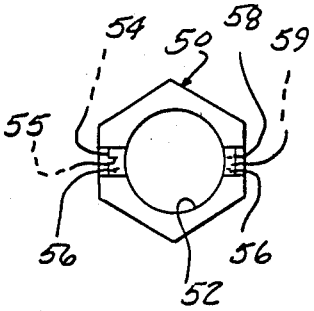
FIG. 11 is an end view of the male hex coupler.
Figure 9:
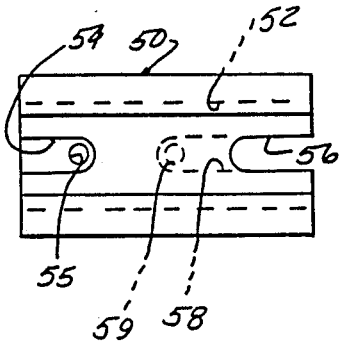
FIG. 9 is a side view of a male hex coupler.
Figure 10:
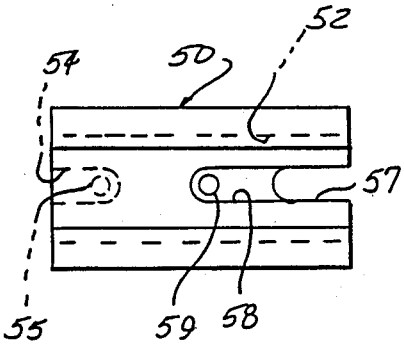
FIG. 10 is a side view of an opposite side of the male hex coupler shown in FIG. 9.
Figure 24:
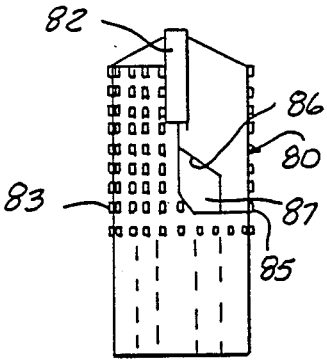
FIG. 24 is a side view of a drill bit.
Figure 25:
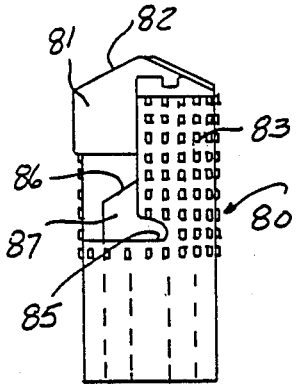
FIG. 25 is another side view of the drill bit shown in FIG. 24 rotated 90° about the longitudinal axis of the drill bit.
Figure 26:
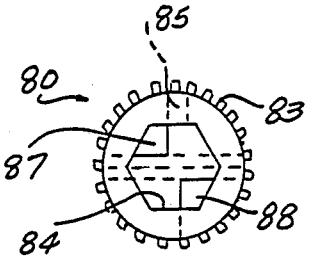
FIG. 26 is an end view of the drill bit shown in FIGS. 24 and 25.

The male hex coupler 50 is depicted in FIGS. 9 through 11. The male hex coupler 50 has an exterior hexagonal surface defining a male hex fitting at each end, and has a longitudinal bore 52 through the entire length of the male hex coupler 50. A first end of the male hex coupler 50 has an elongated longitudinal recess 54 with a clip engaging depression or aperture 55. A second end of the male hex coupler 50 has opposing elongated longitudinal slots 56 and 57 respectively. A second elongated longitudinal recess 58 extends from one of the slots with a second clip-engaging depression or aperture 59. The male hex coupler 50 is used to connect two female hex fittings together, such as the second end of the combination driver 40 with the female hex coupler 60, or the like.

Figure 13A:
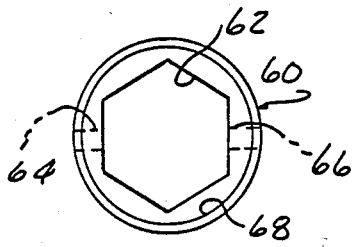
FIG. 13 is an end view of the female hex coupler.
Figure 13B:
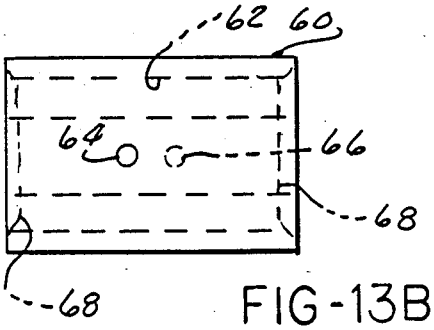

The female hex coupler 60 is shown in FIGS. 12 and 13. The female hex coupler 60 has a cylindrical exterior surface with a hexagonal shape interior longitudinal aperture 62 defining female hex fittings at each end. The female hex coupler 60 has clip-engaging apertures, 64 and 66, longitudinally alignable with the longitudinal recess and clip engaging aperture of respective male hex fittings to be coupled. Preferably, the female hex coupler 60 includes a countersunk portion 68 at each end. The female hex coupler 60 is used to connect two male hex fittings together, such as two ends of adjacent universal bars, or one end of a male hex coupler and another end of a universal bar, or the like.

Figure 14:
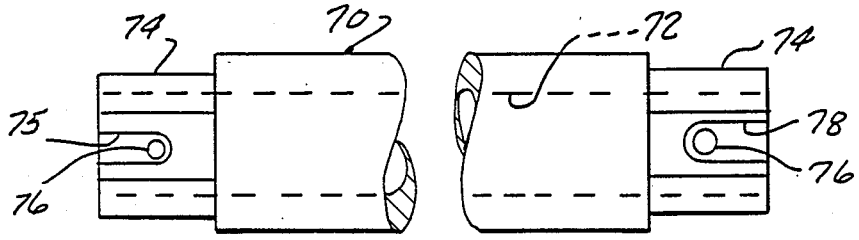
FIG. 14 is a side view of a universal bar.
Figure 15:
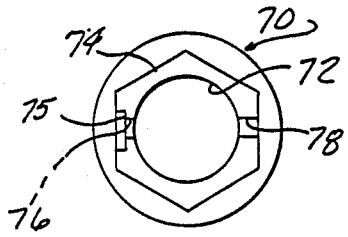
FIG. 15 is an end view of the universal bar.

The universal bar 70 is depicted in FIGS. 14 and 15. The universal bar 70 has a cylindrical or tubular cross-section with a longitudinal bore 72 throughout the entire length. The universal bar 70 has identical first and second ends with hexagonal shaped exterior surfaces defining male hex fittings 74. The male hex fittings 74 have an elongated longitudinal recess 75 with a clip-engaging depression or aperture 76 disposed on a first surface of the hexagonal shaped exterior of the male hex fittings 74. On a second surface of the hexagonal shaped exterior surface of the male hex fittings 74, the universal bar 70 has an elongated longitudinal slot 78. Preferably the first surface of the hexagonal shaped exterior surface of the male hex fittings 74 is opposite from the second surface. The male hex fittings 74 of the universal bar 70 can be connected to any of the female hex fittings, such as the female hex fitting in the second end of the combination driver 40, or the female hex fitting of the female hex coupler 60, or the female hex fitting of a drill bit 80, or the like. The universal bar is used to extend the longitudinal length of the drill steel during drilling and bolting operations.

A drill bit 80 having a female hex fitting, shown in FIGS. 1, and FIGS. 24 through 26, can be connected to a male hex fitting of the drill steel. The drill bit 80 has a substantially cylindrical form with an annular portion and a tapered conical end portion. The tapered conical end portion has a cross-ways extending slot which receives and supports a cutting tip 81. The cutting tip 81 is preferably formed of a suitable high strength carbide alloy and is secured within the slot in the drill bit 80 by suitable means, such as by welding. The cutting tip 81 is provided with a substantially V-shaped tapered surface 82 which acts as the primary cutting surface for the interchangeable sectional mining drill system. Preferably, a plurality of cutting teeth 83 are formed in a circumferentially and longitudinally spaced manner on the annular portion of the drill bit 80. The cutting teeth 83 function to cut and size the hole during removal of the interchangeable sectional mining drill system from the hole. Opposite from the tapered conical end portion of the drill bit 80, the drill bit has a hexagonal shaped recess 84 engagable with any of the male hex fittings previously described. The drill bit 80 also includes a clip-engaging aperture or slot 85 which is spaced longitudinally from the open end of the hexagonal shaped recess 84. The drill bit 80 also includes an internal bore 86 which extends partially through the drill bit 80 and is in communication with at least one preferably a pair of apertures 87 and 88 formed in the annular portion and the tapered conical end portion of the drill bit 80. The apertures 87 and 88 are formed to direct dirt and debris generated during the cutting or drilling operation to the internal bore 86 for removal from the cutting area in a vacuum debris removal system, or to direct water through the internal bore 86 during the cutting or drilling operation for removal of dirt and debris from the cutting area in a water flush debris removal system. It should be recognized that a drill bit having a male hex fitting can also be connected to the drill steel of the present invention by use of a female hex coupler 60 on the end of a universal bar 70 or the like.

Figure 17:
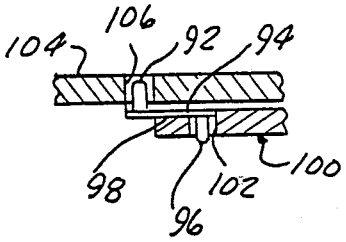
FIG. 17 is a cross-sectional side view showing the flat spring clip engaging in the clip-engaging apertures of typical male and female hex fittings.
Figure 16:
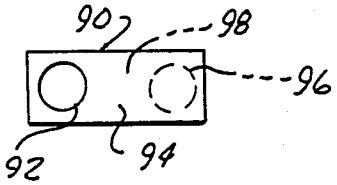
FIG. 16 is a plan view of a flat spring clip.

The various male and female hex fittings described previously are releasably locked together using a flat spring clip 90, shown in FIGS. 16 and 17. The flat, or double dimple, spring clip 90 has a flat elongated member with a first dimple 92 at one end extending outwardly from a first surface 94 and a second dimple 96 at another end extending outwardly from a second surface 98. The flat spring clip 90 is used in the following manner with any of the male and female hex fittings previously described. A male hex fitting, designated generally as 100, is selected, and the flat spring clip 90 is positioned within the elongated longitudinal recess with one of the dimples extending into the clip-engaging aperture, designated generally as 102. An element having a female hex fitting, designated generally as 104, is selected, the outwardly protruding dimple from the spring clip 90 in the male hex fitting 100 is depressed while engaging the male hex fitting 100 within the female hex fitting 104, while aligning the clip-engaging aperture, designated generally 106, of the female fitting 104 with the clip-engaging aperture 102 of the male fitting 100. When the dimple reaches the clip-engaging aperture 106 of the female fitting 104, the dimple will spring up to releasably lock the male and female hex fittings together. The locked position of the flat spring clip 90 is shown in cross section in FIG. 17.

The above identified elements of the mining drill and bolt driver system of the present invention can be combined in the following manner to simulate known drill steel sections, commonly referred to as a starter bar, an extension bar, a pusher bar, a finishing bar, and a roof bolting bar. A finishing bar corresponds to the universal bar 70 releasably connected with a flat spring clip 90 to a drill bit 80. The extension bar corresponds to a universal bar 70 releasably connected with a flat spring clip 90 to a female hex coupler 60. A pusher bar corresponds to a combination driver 40 releasably connected with a flat spring clip 90 to a first end of a universal bar 70, and a female hex coupler 60 releasably connected with a second flat spring clip 90 to the second end of the universal bar 70. A starter bar corresponds to a combination driver 40 releasably connected with a first flat spring clip 90 to a male hex coupler 50 at one end, and at another end of the male hex coupler 50, a female hex coupler 60, releasably connected with a second flat spring clip 90, at another end of the female hex coupler 60, a universal bar 70 releasably connected with a third flat spring clip 90, and, at another end of the universal bar 70, a drill bit 80 releasably connected with a fourth flat spring clip 90. A roof bolting bar corresponds to a first combination driver 40 releasably connected to a universal bar 70 with a flat spring clip 90, at another end of the universal bar 70, a second combination driver 40 releasably connected by a second flat spring clip 90, and a bolt wrench driver 30 releasably connected to the second combination driver 40 with set screws, dowels, or roll pins engaged through aligned retaining apertures. It should be readily apparent that other combinations of the elements described above are possible, those combinations described immediately above are given for illustration purposes only, and other combinations of the elements of the present invention are considered within the scope of the disclosure and claims set forth herein.

The passage means or longitudinal bore described in each of the elements of the present invention provide an open passage from the drill bit 80 through each element to the chuck 10 such that a conventional vacuum debris removing system can be conventionally attached to the mining drill and bolt roofing system of the present invention. The following describes in detail the preferred method for adapting the mining drill and bolt driver system of the present invention to use a fluid flow debris flushing system, such as water.

Figure 28:
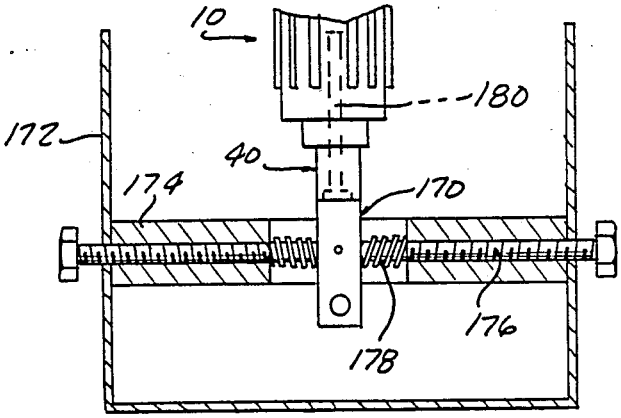
FIG. 28 is a cross sectional view of the fluid flow system base shown in FIG. 27.
Figure 27:
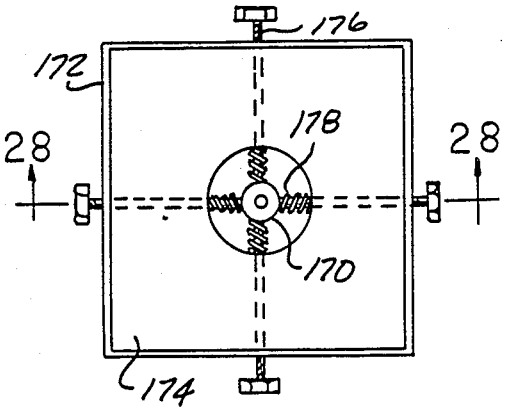
FIG. 27 is a plan view of a fluid flow system base.

A conventional main water valve 170 shown in FIGS. 27 and 28, such as that manufactured by Deublin Co. under the name DEUBLIN UNION, which is commercially available, is disposed adjacent the chuck 10, longitudinally opposite from the drill bit 80. A first combination driver 40 connects the rotatable pipe 180 of the main water valve to the chuck 10. The main water valve 170 is disposed within a nonrotatable debris catching pan 172. A support member 174 extends generally horizontally in a plane at the midsection of the main water valve 170. Adjustable means for clamping the main water valve 170 to prevent rotation of the body of the valve is provided. The adjustable clamping means may comprise a plurality of bolts 176 passing through the support member 174. Means for dampening the vibration from the main water valve 170 are also provided. The dampening means may comprise a plurality of springs 178 interposed between the body of the main water valve 170 and the support member 174. A first normally closed water valve 110 can be threadingly engaged in the threaded portion of the longitudinal bore 46 of the combination driver 40 as previously described. The first normally closed water valve 110 is depicted in FIG. 18. The first normally closed water valve 110 has an external threaded cylindrical surface with a first end and a second end. The first end has a first nozzle 112 with an opening communicating with a longitudinal bore through the body of the first valve 110. The second end has a reduced threaded cylindrical exterior surface for threadingly engaging a valve housing 114. The valve housing 114 encloses an integral valve seat wall 116, a valve ring seal 117 engagable with the integral seat wall 116, a reciprocal valve member 118 engagable with the valve ring seal 117, and means 119 for biasing the reciprocal valve member 118 in a normally closed direction. The first valve 110 threadingly engages within the threaded portion of the longitudinal bore in the first end or male square fitting 42 of the combination driver 40. The first valve 110 is adjustable by threading the first valve 110 a desired longitudinal distance into the threaded portion of the longitudinal bore 46 of the combination driver 40. The first valve 110 can then be secured in place with set screws through selected retaining apertures 44 of the combination driver 40. The first valve 110 is adapted to be opened in response to longitudinal movement of a second nozzle 130 disposed adjacent to the integral valve seat wall 116 of the valve housing 114. The first nozzle 112 of the first valve 110 engages an extension pipe 180 of the main water valve 170.

Figure 20:
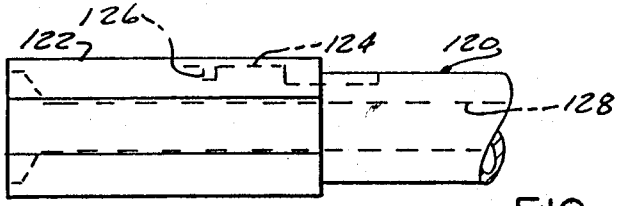
FIG. 20 is a partial side view showing a first end of the second water valve rotated 90° about a longitudinal axis from the view shown in FIG. 19.
Figure 19:
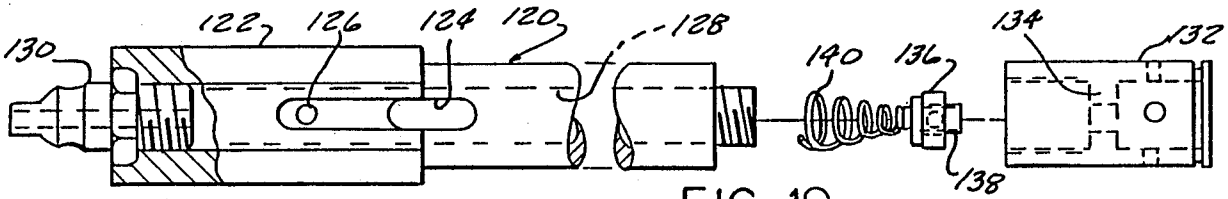
FIG. 19 is an exploded view of a second normally closed water valve.

A second normally closed water valve 120 is depicted in FIGS. 19 and 20. The second normally closed water valve 120 has a cylindrical or tubular shape with a longitudinal bore 128 through an entire length of the second normally closed water valve 120. The second valve 120 has a first end with an exterior hexagonal shaped surface defining a male hex fitting 122 with an elongated longitudinal recess 124 extending from the tubular section along a portion of a first surface of the male hex fitting 122. The elongated longitudinal recess 124 includes a clip-engaging depression 126 disposed spaced from the tubular section of the second valve 120. The first end of the second valve 120 also includes a threaded portion of the interior longitudinal bore 128 for threadingly engaging a second nozzle 130 having an opening communicating with the longitudinal bore 128. The second end of the second valve 120 has a reduced cross section with an exterior threaded surface for threadingly engaging a valve housing 132. The valve housing 132 encloses an integral valve seat wall 134, a valve ring seal 136 engagable with the integral valve seat wall 134, a reciprocal valve member 138 engagable with the valve ring seal 136, and means 140 for biasing the reciprocal valve member 138 in a normally closed direction. Preferably, the valve housings 114 and 132, the integral valve seat walls 116 and 134, the valve ring seals 117 and 136, the reciprocal valve members 118 and 138, and the means for biasing 119 and 140 are identical in all respects. The second normally closed water valve 120 is insertable within an extension bar comprising the combination of a universal bar 70 releasably connected by a flat spring clip 90 to a female hex coupler 60, as previously described. Each extension bar used during the drilling process has a second normally closed water valve 120 inserted within it to provide pressurized water successively through each extension bar section as the length of the drill steel is increased.

The finishing extension water insert 150 is shown in FIGS. 21 through 23. The insert 150 is engagable within the universal bar 70 immediately adjacent the drill bit 80. The insert 150 includes a tubular section having a longitudinal bore 152 through an entire length of the insert 150. The insert 150 has a first end with a threaded portion of the longitudinal bore 152 for threadingly receiving a third nozzle 154, which is normally disposed within the valve housing 132 of an immediately longitudinally adjacent second valve 120. The third nozzle 154 has an opening in communication with the longitudinal bore 152 of the insert 150. The second end of the insert 150 has an enlarged portion 156 engagable within the drill bit 80. Two opposing elongated longitudinal recesses, 158 and 160 respectively, are formed in the enlarged portion 156 extending along a portion of the tubular section of the insert 150. The elongated longitudinal recesses provide sufficient space for the flat spring clip 90 to bend inwardly, while engaging and disengaging the flat spring clip 90 within the clip-engaging aperture 106 of a female hex fitting 104.

After the water system elements have been installed as previously described, water is fed from the main water valve 170 until it reaches the normally closed valve of the first valve 100. When the drill bit engages the surface to be drilled the clip-retaining apertures permit the drill steel sections to move slightly toward the chuck 10 of the drilling machine thereby successively unseating each of the valve ring seal members by moving the reciprocating valve member against the urging of the means for biasing, thereby permitting the water to flow through the valve housing 114 of the first valve 100, through the nozzle 130 of the second valve 120 passing through the longitudinal bore 128 of the second valve 120, opening the valve ring seal 136 of each successive second valve 120 by moving the reciprocal valve member 138 against the urgings of the biasing means 140 until it reaches the finishing extension water insert 150 passing through the valve 154 and the longitudinal bore 152 into the drill bit 80. Releasing the drilling pressure from the drill bit 80 successively causes each drill steel section to move slightly longitudinally away from the chuck 10, thereby closing each successive normally closed valve between the first valve 100 and the final water system insert 150.

It should be noted that in forming a starter bar in accordance herewith, the male hex coupler 50 and female coupler 60 can be mounted in telescoping relationship intermediate the bit 80 and the universal bar 70. In use, this means that only either one of the couplers and not the bar 70 will wear out first before the bar, thereby prolonging the life of the bar 70. Thus, the present invention defines a dual purpose male driver.

What is claimed is:

1. An interchangeable, sectional mining drill and bolt driver system for use with a drilling machine, comprising:

(a) a universal bar having an elongated hollow cylindrical shape with first and second ends, the first end having an exterior polygonal cross-section defining a first male fitting with a first longitudinal recess extending from the first end along a portion of a first surface of the first male fitting, said recess having a clip-engaging aperture therein, the first male fitting further having a slot extending from the first end along a portion of a second surface of said first male fitting, said second surface opposing said first surface, the second end being configured similarly to the first end, the second end including a second male fitting;

(b) a female polygonal coupler having an elongated cylindrical exterior shape with a polygonally shaped interior longitudinal aperture defining a female fitting at each end, including a first female fitting at a first end thereof and a second female fitting at a second end thereof, each female fitting being engagable with said first or second male fitting and having a clip-engaging aperture spaced from an end thereof;

(c) a first planar spring clip having a first projection adjacent a first end thereof extending outwardly from a first surface for engagement with a clip-engaging aperture of a male fitting and a second projection adjacent a second end thereof extending outwardly from a second surface for engagement with a clip-engaging aperture of a female fitting, wherein the combination of said universal bar, said female polygonal coupler and said planar spring clip define an extension bar;

(d) a first combination driver having a first end with an external geometric cross-section defining a third male fitting and a second end with an internal polygonally shaped aperture defining a third female fitting, said third female fitting having a clip-engaging aperture spaced from said second end of the combination driver, said first end of the combination driver having a longitudinal bore formed therethrough in communication with said third female fitting;

(e) a second planar spring clip having a first projection adjacent a first end thereof extending outwardly from a first surface for engagement with a clip-engaging aperture of a male fitting and a second projection adjacent a second end thereof extending outwardly from a second surface for engagement with a clip-engaging aperture of a female fitting, wherein the combination of said extension bar, said first combination driver and said second planar spring clip define a pusher bar;

(f) a male coupler having an exterior surface with a polygonal cross-section along an entire longitudinal length thereof and a longitudinal bore formed through said entire length, said exterior surface defining a fourth male fitting at a first end of said male coupler, and further defining a fifth male fitting at a second end of the male coupler, said first end of the male coupler having a longitudinal recess extending therefrom along a portion of a first surface of said fourth male fitting, said recess having a clip-engaging aperture therein, the male coupler having a second end having opposing slots extending from said second end along said first surface and a second opposing surface, said second end further having a second longitudinal recess of the male coupler extending from one of said opposing slots along a portion of said male fitting, said second recess of the male coupler having a clip-engaging aperture therein;

(g) third and fourth planar spring clips, each clip having a first projection adjacent a first end thereof end extending outwardly from a first surface for engagement with a clip-engaging aperture of a male fitting, and a second projection adjacent a second end thereof extending outwardly from a second surface for engagement with a clip-engaging aperture of a female fitting, wherein the combination of said first combination driver, said male coupler, said female coupler, said universal bar, a drill bit having a fourth female fitting, and said first, second, third, and fourth planar spring clips define a starter bar;

(h) a bolt wrench-drill driver having a cylindrical exterior surface, a first end and a second end, the first end thereof having a first recess, the second end thereof having a second recess offset rotationally about a longitudinal axis by 45° from said first recess, said first and second recesses defining fifth and sixth female fittings, each female fitting thereof having retaining apertures extending through opposing side walls thereof;

(i) a geometric driver having an exterior geometric cross-section throughout an entire length of the geometric driver, said exterior geometric cross-section defining sixth and seventh male fittings at first and second ends of said geometric driver, said sixth and seventh male fittings having retaining apertures extending through said geometric driver, said geometric driver further having a longitudinal bore through the entire length of the geometric driver; and a retaining member engagable within the retaining apertures of said bolt wrench-drill driver and said geometric driver to releasably lock said geometric driver to said bolt wrench-drill driver, wherein the combination of the first combination driver, said universal bar, a second combination driver substantially identical to the first combination driver, said bolt wrench-drill driver, said retaining member, and said first and second planar spring clips define a roof bolting bar, and wherein the combination of said geometric driver, said bolt wrench-drill driver, said first combination driver, and said retaining member defines an interchangeable, sectional drill driver having a replaceable male fitting engagable with a chuck of a drilling machine.

2. The interchangeable, sectional mining drill and bolt driver system of claim 1, further comprising:

(a) said first combination driver having a threaded portion of said longitudinal bore adjacent said first end thereof;

(b) a first normally closed fluid flow valve having a threaded exterior surface threadingly engagable within the threaded portion of the combination driver, said first valve having a nozzle at a first end thereof and a valve housing at a second end thereof, said valve housing enclosing an integral valve seat wall, a valve seal engagable with said valve seat wall, a reciprocal valve member engagable with said valve seal, and means for biasing said reciprocal valve member in a normally closed direction;

(c) a second normally closed fluid flow valve engagable within said universal bar, a first end of the second fluid flow valve further having a nozzle, and a second end of the second fluid flow valve having a valve housing enclosing an integral valve seat wall, a valve seal engagable with said valve seat wall, a reciprocal valve member engagable with said valve seal, and means for biasing said reciprocal valve member in a normally closed direction; and (d) a finishing extension fluid flow insert engagable within said universal bar adjacent an end thereof, said insert having an elongated tubular section with a first end and a second end, said first end thereof having a nozzle in communication with an interior longitudinal bore of said elongated tubular section, said second end thereof having an enlarged portion engagable within a drill bit, said second end of the tubular section having elongated longitudinal recesses extending from said enlarged portion along a portion of said elongated tubular section, wherein said first and second fluid flow valves and said insert are engagable within said combination driver, said extension bar, and said universal bar adjacent said drill bit, respectively, to define an internal fluid flow flush system to deliver fluid to said drill bit to flush debris away from said drill bit.

3. In a mining drill steel system for use with a drilling machine;

the improvement comprising an interchangeable, sectional driver including:

(a) a replaceable geometric driver having an external geometric cross-section along a longitudinal length of said geometric driver, said external cross-section defining first and second male fittings at a first end and a second end, respectively, of the geometric driver, said first end being engagable within a female fitting of a chuck of a drilling machine, said square geometric driver having a longitudinal bore extending through the length of the geometric driver, said second end thereof having retaining apertures extending through opposing sidewalls of said geometric driver;

(b) a bolt wrench-drill driver having a first end and a second end, the first end thereof having a first geometric recess therein defining a first female fitting engagable with an end of the geometric driver, the second end of the bolt wrench-drill driver having a second recess therein defining a second female fitting offset rotationally about a longitudinal axis of said bolt wrench-drill driver by 45° from said first recess, said first and second recesses having retaining apertures extending therefrom and passing through side walls of said bolt wrench-drill driver;

(c) a combination driver having a first end with an exterior geometric cross-section defining a third male fitting engagable with a female fitting of said bolt wrench-drill driver, and the combination driver including a second end having an interior polygonal aperture defining a third female fitting, said first end of the combination driver having retaining apertures formed through opposing side walls to secure said combination driver to said bolt wrench-drill driver, and said third female fitting having a clip-engaging aperture spaced from said second end of the combination driver;

(d) first and second retaining members for releasably engaging aligned retaining apertures to secure said geometric driver with said bolt wrench-drill driver, and to secure said bolt wrench-drill driver with said combination driver.

4. The improvement of claim 3, further comprising:

(a) a male coupler having an exterior surface with a polygonal cross-section along an entire length of said male hex coupler, and a longitudinal bore formed therethrough, said exterior surface defining fourth and fifth male fittings at first and second ends of the male coupler, said first end thereof having a first longitudinal recess extending along a portion of a first surface of said male coupler, said recess having a clip-engaging aperture spaced from said first end of the male coupler, said second end thereof having opposing slots extending along said first surface and a second opposing surface of the male coupler, a second longitudinal recess extending from one of said opposing slots along a portion of said fifth male hex fitting, said second longitudinal recess having a clip-engaging aperture spaced from said second end of the male coupler; and (b) a planar spring clip having a first projection adjacent a first end thereof, the first projection extending outwardly from a first surface of the clip for engagement with a clip-engaging aperture of a male fitting, and the clip having a second projection adjacent a second end thereof and extending outwardly from a second surface of the clip for engagement with a clip-engaging aperture of a female hex fitting.

5. The improvement of claim 3, further comprising:

said combination driver having a threaded portion of said longitudinal bore adjacent said first end thereof; and a first normally closed fluid flow valve having a threaded external surface threadingly engagable within the threaded portion of said longitudinal bore of said combination driver, said first valve further having a first end and a second end, said first end of the valve having a nozzle with an opening communicating with a longitudinal bore of said first valve, said second end of the valve having a valve housing enclosing an integral valve seat, a valve seal engagable with said valve seat, a reciprocal valve member engagable with said valve seal, and means for biasing said reciprocal valve member in an normally closed direction.

6. The improvement of claim 3, further comprising:

a chuck having a generally cylindrical exterior surface, a first end, a second end, and a longitudinal axis, said exterior surface having a plurality of teeth formed thereon engagable with a drilling machine for translation of rotational motion to said chuck, the first end having a first geometric recess, the second end having a second geometric recess offset rotationally about the longitudinal axis of the chuck by 45 degrees from said first geometric recess, said first and second geometric recesses defining fourth and fifth female fittings, said chuck having a longitudinal through bore communicating with said fourth and fifth female fittings.

7. The improvement of claim 6, further comprising:

a fluid flow debris flushing system support base for supporting a main water valve with respect to a nonrotatable debris collection container, the water valve adapted to be connected to the chuck for providing water flow through the longitudinal through bore thereof, said system base having a generally horizontal support member connected to said debris collection container, adjustable means for clamping said main water valve against rotational movement, means for dampening vibration from said main water valve against rotational movement, and means for dampening vibration from said main water valve to said debris collection container.

8. The improvement of claim 3, further comprising:

(a) a universal bar having an elongated tubular shape with first and second ends, the first end of the universal bar having an exterior polygonal cross-section defining a sixth male fitting engagable with a female fitting, said sixth male hex fitting having a longitudinal recess extending therefrom along a portion of a first surface of said sixth male fitting, said recess having a clip-engaging aperture therein, the sixth male hex fitting further having a slot extending from the first end of the bar along a portion of a second surface of said sixth male fitting opposing said first surface, the second end of the bar having structure corresponding to that of the first end and including a seventh male fitting; and (b) a planar spring clip having a first projection adjacent a first end thereof extending outwardly from a first surface thereof for engagement with said clip-engaging aperture of said sixth male fitting, and a second projection adjacent a second end thereof extending outwardly from a second surface thereof for engagement with a clip-engaging aperture of a female fitting.

9. The improvement of claim 8, further comprising:

a drill bit; and a finishing fluid flow insert engagable within the universal bar engaging the drill bit, said insert having an elongated tubular section with a first end and a second end, said first end of the tubular section having a nozzle with an opening communicating with a longitudinal bore of said elongated tubular section, said second end of the tubular section having an enlarged portion engagable within said drill bit, said second end of the tubular section further having first and second longitudinal recesses extending from said elongated tubular section through a portion of said enlarged portion.

10. The improvement of claim 9, wherein the drill bit comprises:

a normally cylindrical exterior surface with a tapered conical portion at a first end thereof supporting a cutting tip, a second end of the drill bit having a polygonal shaped recess defining a sixth female fitting and a clip-engaging aperture spaced from said second end of the drill bit.

11. The improvement of claim 8, further comprising:

a female coupler having a polygonal shaped longitudinally extending aperture defining a female fitting at each end thereof engagable with a male fitting, each female fitting of the female coupler having a clip-engaging aperture spaced from each end and longitudinally alignable with said clip-engaging aperture of a male fitting.

12. The improvement of claim 11, further comprising:

a second normally closed fluid flow valve engagable within said bar and said female hex coupler, said second valve having an elongated tubular section with a first end and a second end, said first end of the tubular section having a nozzle with an opening communicating with a longitudinal bore through said elongated tubular section, said first end of the tubular section further having an exterior hexagonal shaped cross-section defining a third male hex fitting having a longitudinal recess extending from said elongated tubular section along a portion of a first surface of said third male hex fitting, said recess having a clip-engaging aperture spaced from said elongated tubular section, said second end having a valve housing threadingly engaged with said elongated tubular section, said valve housing enclosing an integral valve seat wall, a valve seal engagable with said valve seat wall, a reciprocal valve member engagable with said valve seal, and means for biasing said reciprocal valve member in a normally closed direction.

13. A mining drill steel system for use with a drilling machine to drill vertical support holes in the roof of an underground mine, comprising:

a starter bar;

a roof bolting bar; and a drill driver;

each of the starter bar, the roof bolting bar, and the drill driver being formed of a plurality of sections disengagably attached to one another and being disassemblable into a plurality of sections.

14. The drill steel system of claim 13, further comprising a pressurized water debris flushing system disposed within the drill steel system.

15. The drill steel system of claim 14, wherein the water debris flushing system comprises:

a water system base;

a first normally closed water valve disposed within the starter bar; and a finishing extension water insert disposed within the drill driver.

16. An interchangeable, sectional mining drill and bolt driver system for use with a drilling machine, comprising:

a universal bar having an elongated hollow cylindrical shape with first and second ends, the first end having an exterior polygonal cross-section defining a first male fitting with a first longitudinal recess extending from the first end along a portion of a first surface of the first male fitting, said recess having a clip-engaging aperture therein, the first male fitting further having a slot extending from the first end along a portion of a second surface of said first male fitting, said second surface opposing said first surface, the second end being configured similarly to the first end, the second end including a second male fitting;

a female polygonal coupler having an elongated cylindrical exterior shape with a polygonally shaped interior longitudinal aperture defining a female fitting at each end, including a first female fitting at a first end thereof and a second female fitting at a second end thereof, each female fitting being engagable with said first or second male fitting and having a clip-engaging aperture spaced from an end thereof;

a first planar spring clip having a first projection adjacent a first end thereof extending outwardly from a first surface for engagement with a clip-engaging aperture of a male fitting and a second projection adjacent a second end thereof extending outwardly from a second surface for engagement with a clip-engaging aperture of a female fitting, wherein the combination of said universal bar, said female polygonal coupler and said planar spring clip define an extension bar.

17. The system of claim 16, further comprising:

a first combination driver having a first end with an external geometric cross-section defining a third male fitting and a second end with an internal polygonally shaped aperture defining a third female fitting, said third female fitting having a clip-engaging aperture spaced from said second end of the combination driver, said first end of the combination driver having a longitudinal bore formed therethrough in communication with said third female fitting; and a second planar spring clip having a first projection adjacent a first end thereof extending outwardly from a first surface for engagement with a clip-engaging aperture of a male fitting and a second projection adjacent a second end thereof extending outwardly from a second surface for engagement with a clip-engaging aperture of a female fitting, wherein the combination of said extension bar, said first combination driver and said second planar spring clip define a pusher bar.

18. The system of claim 17, further comprising:

a male coupler having an exterior surface with a polygonal cross-section along an entire longitudinal length thereof and a longitudinal bore formed through said entire length, said exterior surface defining a fourth male fitting at a first end of said male coupler, and further defining a fifth male fitting at a second end of the male coupler, said first end of the male coupler having a longitudinal recess extending therefrom along a portion of a first surface of said fourth male fitting, said recess having a clip-engaging aperture therein, the male coupler having a second end having opposing slots extending from said second end along said first surface and a second opposing surface, said second end further having a second longitudinal recess of the male coupler extending from one of said opposing slots along a portion of said male fitting, said second recess of the male coupler having a clip-engaging aperture therein; and third and fourth planar spring clips, each clip having a first projection adjacent a first end thereof end extending outwardly from a first surface for engagement with a clip-engaging aperture of a male fitting, and a second projection adjacent a second end thereof extending outwardly from a second surface for engagement with a clip-engaging aperture of a female fitting, wherein the combination of said first combination driver, said male coupler, said female coupler, said universal bar, a drill bit having a fourth female fitting, and said first, second, third, and fourth planar spring clips define a starter bar.

* * * * *